US005875373A

United States Patent [19]

Sato et al.

[11] Patent Number: 5,875,373

[45] **Date of Patent: *Feb. 23, 1999**

[54] IMAGE FIXING DEVICE HAVING MEANS FOR CONTROLLING CONVEYANCE A TRANSFER MEDIUM

[75] Inventors: Kaoru Sato, Minami Ashigara; Kiyoto Toyoizumi, Odawara, both of Japan

[73] Assignee: Canon Kabushiki Kaisha, Tokyo, Japan

[ * ] Notice: This patent issued on a continued prosecution application filed under 37 CFR 1.53(d), and is subject to the twenty year patent term provisions of 35 U.S.C. 154(a)(2).

[21] Appl. No.: 732,047

[22] Filed: Oct. 17, 1996

[30] Foreign Application Priority Data

Oct. 20, 1995 [JP] Japan ..... 7-297599

[51] Int. Cl.[6] ..... G03G 15/20

[52] U.S. Cl. ..... 399/68; 219/216; 219/492; 399/69

[58] Field of Search ..... 399/33, 67, 68, 399/69, 70, 45; 219/216, 492, 494, 497; 432/60; 430/124

[56] References Cited

U.S. PATENT DOCUMENTS

| | | | |
|---|---|---|---|
| 4,618,242 | 10/1986 | Yamagishi | 399/45 |
| 5,191,375 | 3/1993 | Hamilton | 399/68 |
| 5,426,494 | 6/1995 | Muto et al. | 399/68 X |
| 5,682,576 | 10/1997 | Sakai et al. | 399/69 |
| 5,682,577 | 10/1997 | Kiyoi | 399/69 |

*Primary Examiner*—Arthur T. Grimley
*Assistant Examiner*—Sophia S. Chen
*Attorney, Agent, or Firm*—Fitzpatrick, Cella, Harper & Scinto

[57] ABSTRACT

An image fixing device for heating and fixing an unfixed image on a recording medium has a heater, a measuring device for measuring the electrical energization time of the heater per unit time, and a control for decreasing the quantity of the recording medium passing a fixing position per unit time when the measured time by the measuring device reaches a predetermined value.

5 Claims, 8 Drawing Sheets

IMAGE FIXING DEVICE HAVING MEANS FOR CONTROLLING CONVEYANCE A TRANSFER MEDIUM

BACKGROUND OF THE INVENTION

1. Field of the Invention

This invention relates to an image fixing device for use in a recording apparatus such as a copying apparatus of the electrophotographic type, and more particularly to an image fixing device for fixing an unfixed toner on a recording medium by a plurality of heat generating members.

2. Related Background Art

In a recording apparatus according to the prior art, a heat generating member provided in a fixing roller as a fixing member has been great in heat capacity. Therefore, when heat fixing is to be done after a toner image is transferred to transfer paper as a transfer medium, much time is required until the temperature of the heat generating member rises to a desired temperature necessary to melt a toner. Thus, the heat generating member is made to continue it heat generating state from the start till the end of an image forming process. However, the time when the heat generation of the heat generating member becomes necessary is the time when the transfer paper passes through the fixing nip portion and the unfixed toner adhering to the transfer paper is melted and fixed. During the other times, the heat generating member simply radiates heat energy, and this has given rise to the problem that it is not economical and moreover the heat adversely affects the devices around the fixing device.

For this reason, in recent years, the demand for energy saving has also been heightening in recording apparatuses. Particularly in recording apparatuses of the heat fixing type, the electric power consumed by the fixing device is great and in a halogen heater or the like, the rush power during electrical energization is also great and greatly affects the other devices. Therefore, in the latest recording apparatuses, there has been put into practical use a fixing device small in heat capacity and short in wait up time in which the electric power consumed is made as small as possible. On the other hand, the need for recording apparatuses has been widening and the sizes of the paper handled in recording apparatuses ranges widely from A5 to A3.

Therefore, to make the recording apparatus cope with various sizes of paper while reducing the electric power consumed by the fixing device, heat generating members matching the sizes of the paper become necessary and a fixing device having a plurality of heat generating members has been devised. However, even such a fixing device of the energy saving type which has a plurality of heat generating members in accordance with the sizes of paper and can secure a sufficient fixing property under ordinary environment suffers from the problem that the fixing performance is remarkably reduced when the ambient environmental temperature is low and cold paper is to be fixed or when a source voltage applied to the heat generating members is low.

SUMMARY OF THE INVENTION

The present invention has been made in order to solve the problem as noted above and an object thereof is to provide a fixing device having its fixing performance prevented from being reduced when the ambient environmental temperature is low and cold paper is to be fixed or when a source voltage applied to heat generating members is low, and a recording apparatus provided with such fixing device.

Another object of the present invention is to provide an image fixing device provided with control means for monitoring the electrical energization time of the heat generating members per unit time, judging that the device is in low temperature environment or low source voltage environment when the electrical energization time has assumed a maximum electrical energization state, thereby decreasing the amount by which a transfer medium passes a fixing member per unit time.

Further objects of the present invention will become apparent from the following description taken in conjunction with the accompanying drawings.

DESCRIPTION OF THE PREFERRED EMBODIMENTS

Figure 1:
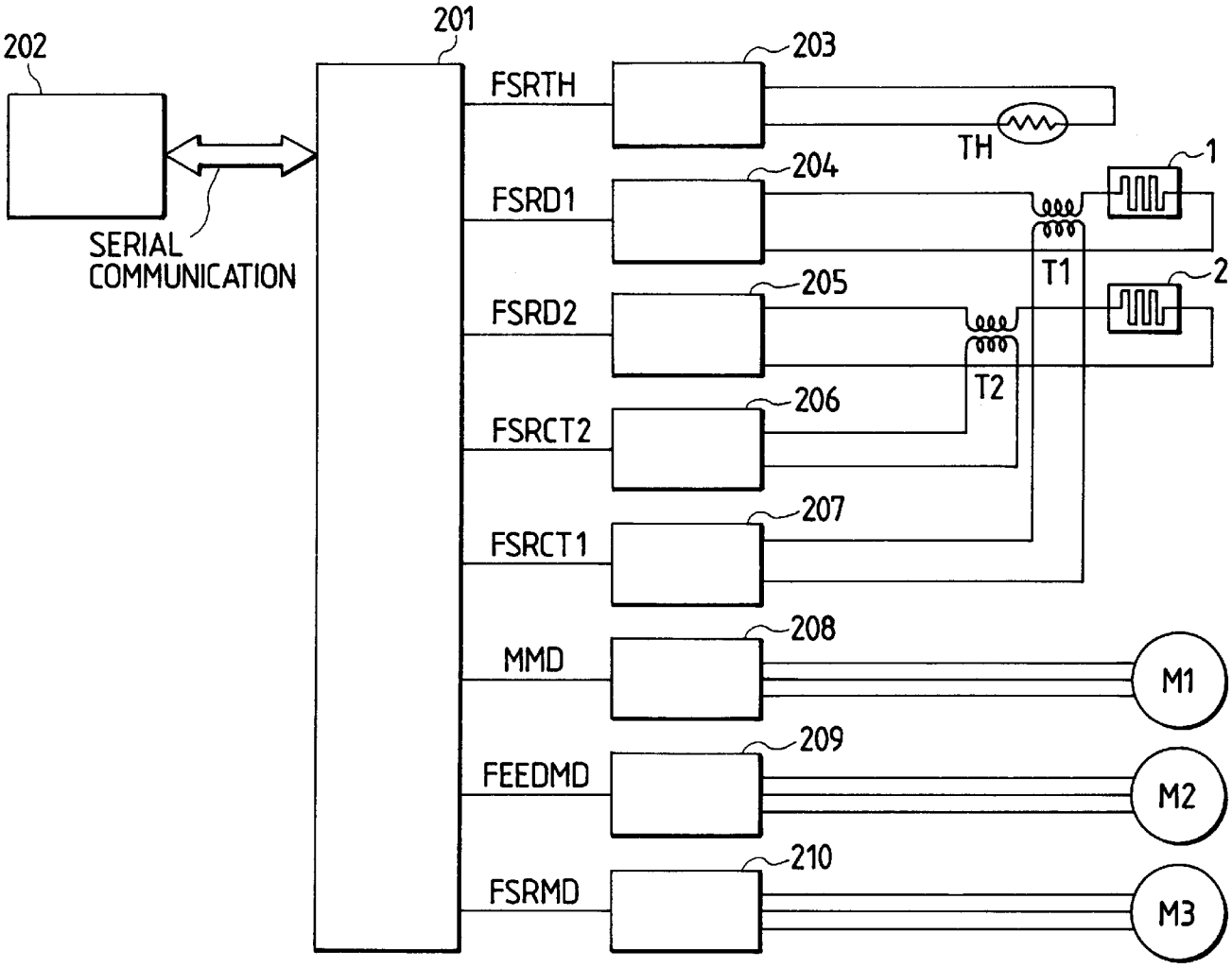
FIG. 1 is a control block diagram showing a fixing device according to the present invention.

Some embodiments of the present invention will hereinafter be described in detail with reference to the drawings.

<First Embodiment>

In FIGS. 1 to 5, the reference numeral 201 designates a microcomputer (hereinafter simply referred to as the "CPU") which is one-chip control means containing a ROM and a RAM therein and which effects serial communication with an image controller 202 providing passage amount decrease control means to thereby effect the control of a fixing device, image control and paper conveyance control.

The reference numeral 203 denotes an input circuit for converting the information of a thermistor TH as temperature detecting means into a voltage signal FSRTH, which is inputted to the analog port of the CPU 201. The reference numeral 204 designates a drive circuit for supplying an AC power source (not shown) to a heat generating member (hereinafter simply referred to as the "heater") 1 such as a halogen heater, and this drive circuit 204 is controlled by a heater control signal FSRD1 outputted from the CPU 201. The reference numeral 205 denotes a drive circuit for supplying an AC power source to a heater (heat generating member) 2, and this drive circuit 205, like the drive circuit 204, is controlled by a heater control signal FSRD2 outputted from the CPU 201. The reference numeral 206 designates an input circuit for the electric current of the heater 2 detected by a current transformer T2, and the electric current of the heater 2 is inputted as a heater current FSRCT2 to the CPU 201 through the input circuit 206.

The reference numeral 207 denotes an input circuit for the electric current of the heater 1 detected by a current transformer T1, and the electric current of the heater 1 is inputted as a heater current FSRCT1 to the CPU 201 through the input circuit 207. The reference numeral 208 designates a drive circuit for a main motor M1, the reference numeral 209 denotes a drive circuit for a sheet supply motor M2, and the reference numeral 210 designates a drive circuit for a fixing roller motor M3, and these motors 208, 209 and 210 are rotated by a main motor drive signal MMD, a sheet supply motor drive signal FEEDMD and a fixing roller motor drive signal FSRMD, respectively, outputted from the CPU 201 and effect the conveyance of a photosensitive drum and paper.

The heater control operation of the fixing device will now be described with reference to FIG. 2.

When the heater control operation is started, either ordinary control or temperature rise ratio control is judged from the current controlled temperature (ST101). If the controlled temperature has risen from the ordinary level, temperature rise ratio measurement is judged to be going on and shift is made to a step ST110, where the following process is carried out. In contrast, if ordinary control is judged, the detected temperature and the controlled temperature are compared with each other (ST102). If the detected temperature is lower than the controlled temperature, the on duty (electrical energization time) of the heater 1 per unit time is checked up by monitor means (ST103), and if it is already the maximum duty, the on duty of the heater 2 per unit time is likewise checked up by the monitor means (ST104). If the heater 2 has also reached the maximum duty, the controlled temperature is raised by a predetermined temperature by temperature setting means.

Also, if the on duty of the heater 1 is not maximum, an on duty up process is carried out (ST106). Likewise, if the on duty of the heater 2 is not maximum, an on duty up process is carried out (ST107). That is, if the detected temperature of the heaters does not reach the controlled temperature, the electrical energization time of the heater 1 and heater 2 per unit time is gradually increased, and if neither of the heater 1 and heater 2 does not reach the maximum on duty, the temperature rise ratio measurement mode is not brought about. If at the step ST102, the detected temperature is higher than the control temperature, at a step ST108, the on duty of the heater 1 is lowered and also at a step ST109, the on duty of the heater 2 is lowered.

After both of the heater 1 and heater 2 reach the maximum on duty and at the step ST110, the temperature rise ratio measuring process is carried out, the detected temperature and the risen controlled temperature are again compared with each other (ST111), and if the detected temperature is higher than the controlled temperature, the process of lowering the on duty of the heater 1 and heater 2 by electrical energization control means is carried out (ST108 and ST109).

Figure 3:
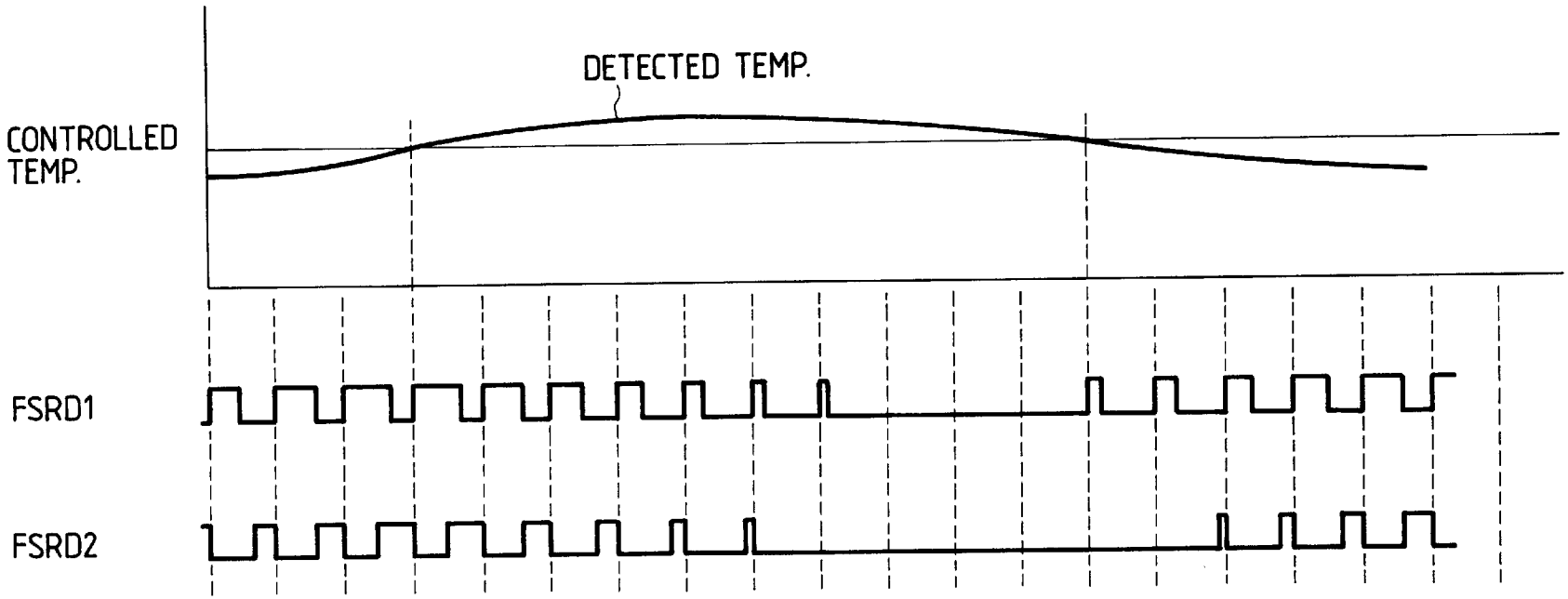
FIG. 3 is a time chart showing the relation between detected temperature and electrical energization time for illustrating the operation of the first embodiment.

When the above-described control is effected, there is obtained the relation between the detected temperature and the on duty as shown in FIG. 3. That is, when the detected temperature is below the controlled temperature, the on duty of the control signals FSRD1 and FSRD2 of the heaters 1 and 2, respectively, within unit time gradually rises, and when the detected temperature is over the controlled temperature, the on duty gradually decreases. As regards the difference in on duty between the control signal FSRD1 of the heater 1 and the control signal FSRD2 of the heater 2, the orientation distributions of the heaters 1 and 2 differ from each other, and the on duty of the heater 1 having the peak of the orientation distribution at a position through which transfer paper (recording paper) of every size passes is made high.

Figure 5:
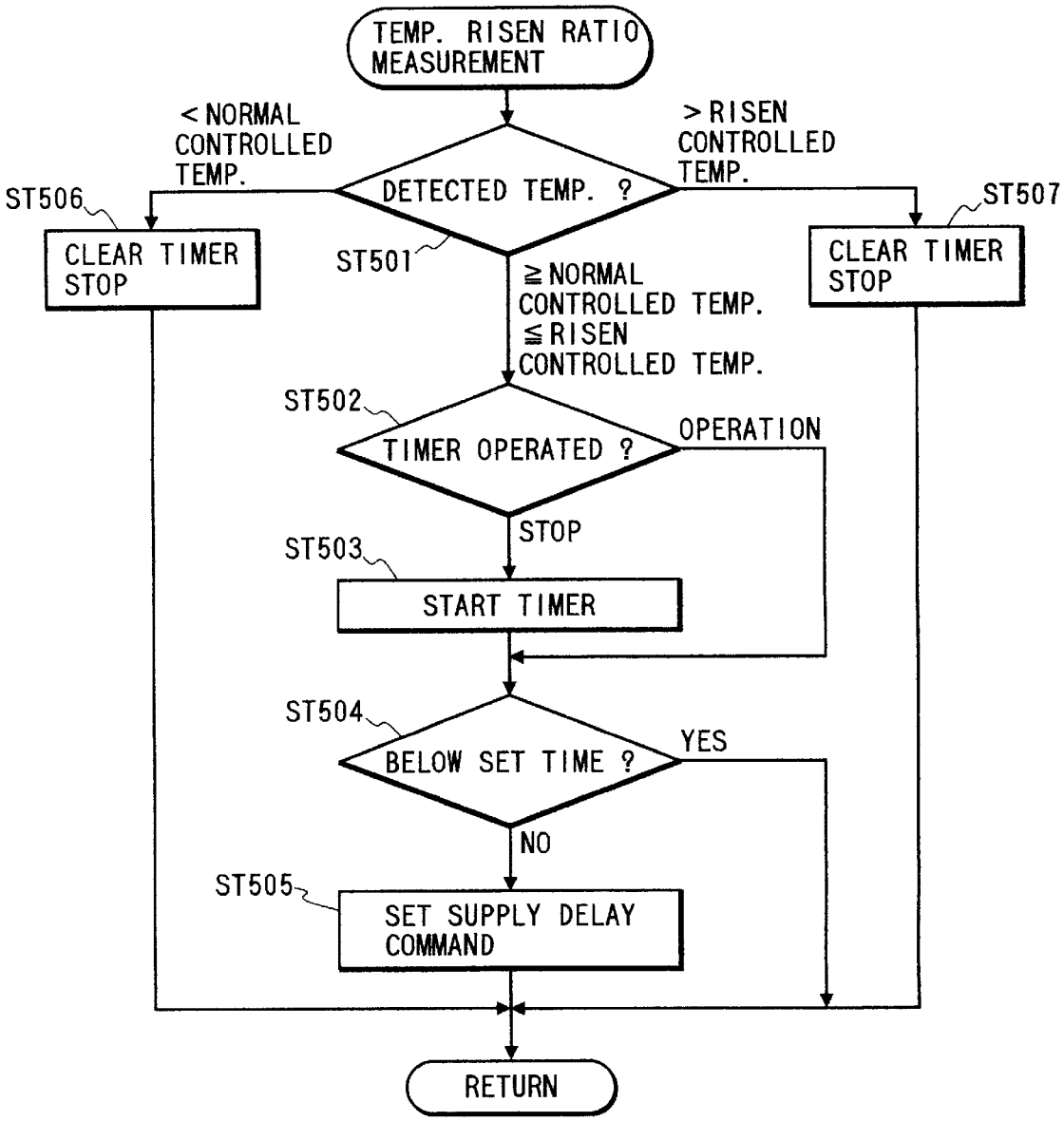
FIG. 5 is a flow chart showing a temperature rise ratio measuring process.

The measuring operation of calculating the temperature rise ratio will now be described with reference to FIG. 5.

When both of the heater 1 and the heater 2 reach the maximum on duty, a temperature rise ratio measuring process is started. First, at a step ST501, the detected temperature is checked up and if it is lower than the ordinary controlled temperature, the rise ratio measurement is not effected and a timer for measurement is stopped and cleared (ST506). Also, if the detected temperature is higher than the risen controlled temperature, the measurement is regarded as having been terminated and the timer for measurement is stopped and cleared (ST507). When the detected temperature is higher than the ordinary controlled temperature and is lower than the risen controlled temperature, the operation of the timer for measurement is checked up (ST502), and if the timer for measurement is being operated, shift is made to a step ST504. Also, if the timer for measurement is being stopped, the timer is started (ST503). Whether within a set time, the detected temperature has reached the risen controlled temperature is measured at the step ST504, and if within the set time, the detected temperature has reached said controlled temperature, the measurement is terminated. Also, if a time longer than the set time has elapsed until the detected temperature reaches the controlled temperature, a sheet supply delay command is set (ST505) and the sheet supply operation is performed at a sheet supply interval by this set timer value.

Figure 4:
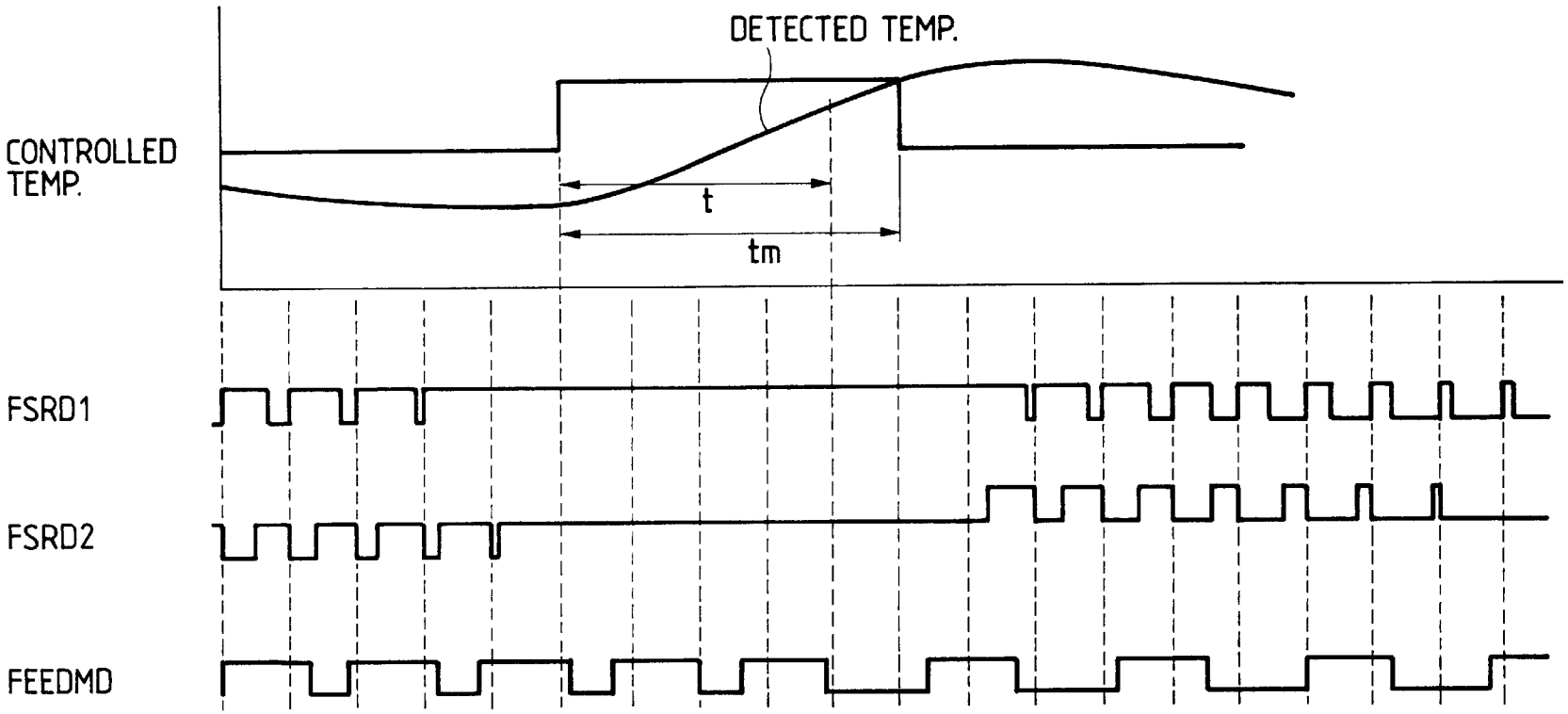
FIG. 4 is a time chart showing the relation among the drive signal, the controlled temperature and the detected temperature of a heater when a voltage applied to a fixing roller is a low source voltage.

FIG. 4 is a time chart showing the control signal FSRD1 of the heater 1, the control signal FSRD2 of the heater 2 and the relation between the controlled temperature and the detected temperature when the source voltage applied to the heaters is low. At a point of time whereat the control signal FSRD1 reaches the maximum on duty and then the control signal FSRD2 reaches the maximum on duty, the controlled temperature rises. In the meantime, the detected temperature gradually falls, but is gradually recovered by the on duty up of the control signal. However, it never happens that the detected temperature reaches a predetermined controlled temperature.

A temperature rise ratio measuring mode is brought about at a point of time whereat the controlled temperature has risen, but a reach time tm is required until the detected temperature reaches a predetermined temperature, and this exceeds a set time t which is a set value. In terms of control, the detected temperature does not reach the controlled temperature at a point of time whereat the set time t has elapsed. Therefore, the drive timing of the drive signal FEEDMD of the sheet supply motor M2 which effects the pickup of transfer paper is delayed and the throughput is decreased. By the above-described control, it becomes possible to decrease the quantity of paper passing the fixing roller per unit time and thus, the temperature of the fixing roller can be kept at the controlled temperature.

<Second Embodiment>

Figure 6:
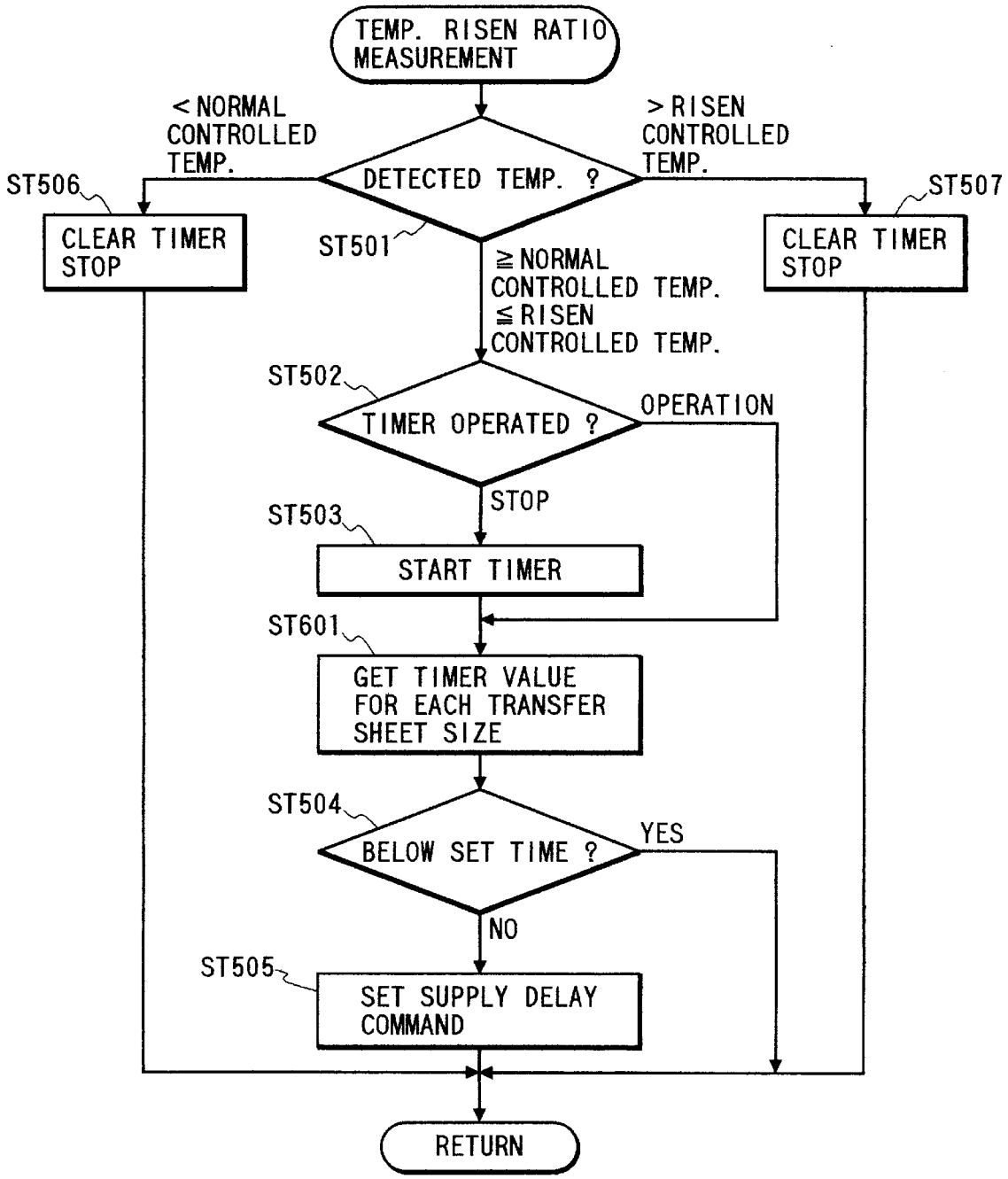
FIG. 6 is a flow chart illustrating the control of a fixing device according to second to fourth embodiments of the present invention.

FIG. 6 is a flow chart showing the control of a second embodiment. In the temperature rise ratio measuring process in the first embodiment, the rise time of the predetermined temperature has been compared at a fixed value. Actually, however, the manner in which the heat of the fixing roller is taken away, i.e., the temperature rise ratio, differs depending on the size of the transfer paper passing the fixing roller. So, in the second embodiment, a temperature rise ratio prescribing value differing for each size of the transfer paper is provided, and the step of measuring whether within the temperature rise ratio prescribing value (set time), the detected temperature has reached the risen controlled temperature (temperature rise ratio calculating means) is provided. That is, the step ST601 of making the temperature rise ratio prescribing value differ for each size of the transfer paper is added to the flow chart shown in FIG. 5 so that the comparing process of a step ST504 may be carried out on the basis of the temperature rise ratio prescribing value set at the step ST601. In the present embodiment, the greater becomes the width of the transfer paper, the longer is made the set time.

<Third Embodiment>

While in the second embodiment, the temperature rise ratio prescribing value has been set for each size of the transfer paper, some recording apparatuses have, besides a cassette sheet supply portion, for example, a manual sheet supply portion capable of handling special transfer paper (thick paper). So, in this embodiment, the temperature rise ratio prescribing value is changed depending on the cassette sheet supply portion and the manual sheet supply portion, besides the size of the transfer paper, and a set time changed depending on the size of the transfer paper and the sheet supply portions is prepared in a step ST601 shown in FIG. 6, whereby the temperature control of the heater 1 and heater 2 can be effected in greater detail.

<Fourth Embodiment>

A fourth embodiment is one in which the temperature of the fixing roller may be detected and memorized at the start of the recording apparatus in order that the fixing performance of fixing an unfixed toner on transfer paper may be obtained well. At the start of the recording apparatus, the fixing roller is not yet electrically energized and therefore, the detected temperature of the fixing roller can be regarded as the ambient environmental temperature. So, when the temperature of the fixing roller at the start is a predetermined temperature or lower, it is judged that the transfer paper is likewise at a low temperature, and as in the third embodiment, the temperature rise ratio prescribing value is set to a level shorter than in a usual case. By so setting, a throughput down mode can be quickly entered. That is, in the present embodiment, if the set time is set by the detected temperature at the start memorized at the step ST601 shown in FIG. 6, the control of entering the throughput down mode can be effected quickly.

<Fifth Embodiment>

Figure 7:
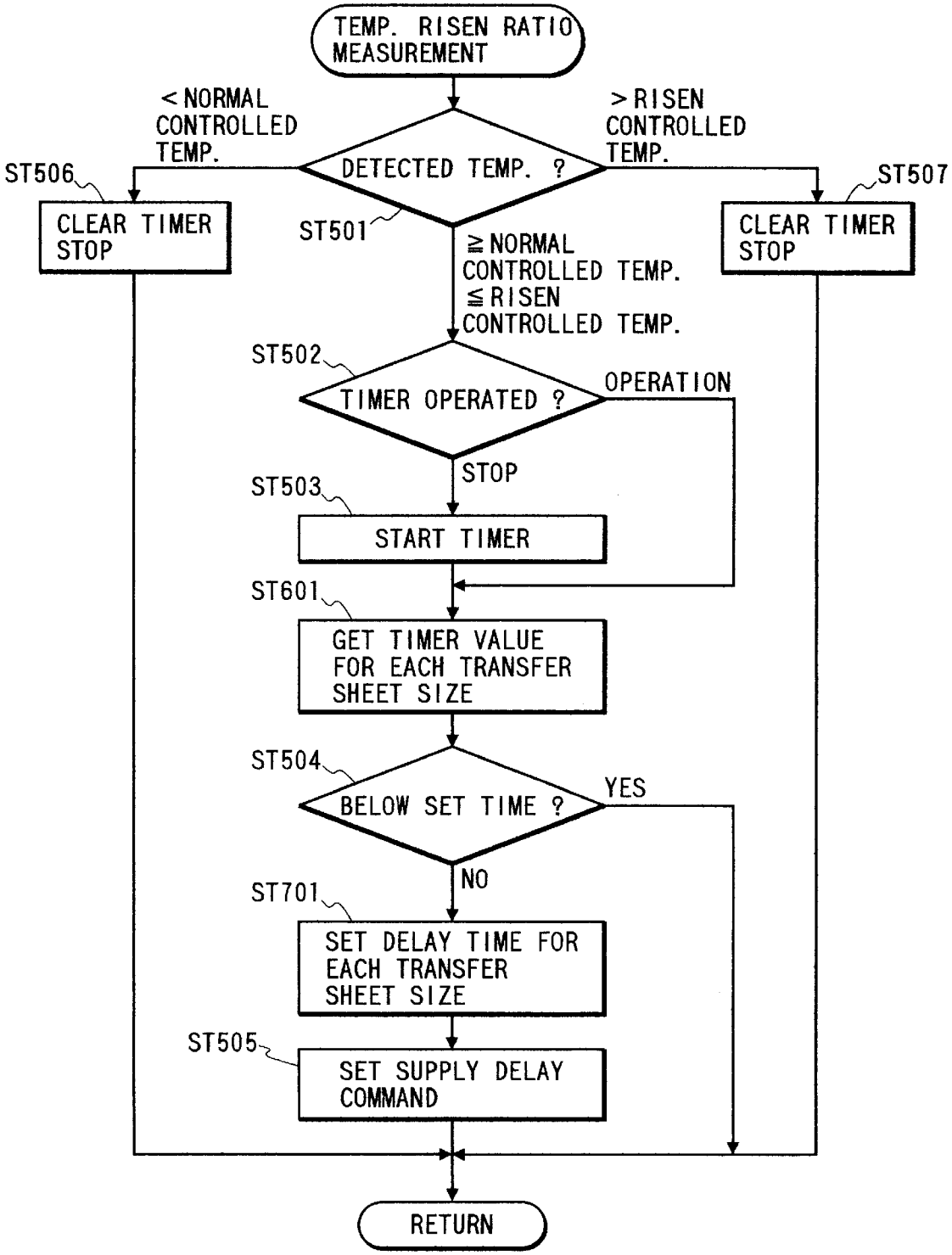
FIG. 7 is a flow chart illustrating the control of a fixing device according to fifth to seventh embodiments of the present invention.

FIG. 7 is a flow chart showing the control of a fifth embodiment. The substance of processing in this embodiment is substantially similar to that in the second embodiment, but in the second embodiment, the temperature rise ratio prescribing value has been variable by the size of the transfer paper so that the timing at which the throughput down mode is entered may be changed. In contrast, in the fifth embodiment, further the sheet supply delay time (sheet supply interval) is changed for each size of the transfer paper. By adding this control, optimum throughput down control can be effected. That is, in the present embodiment, at a step ST701, the sheet supply delay time is made great or throughput down is effected because transfer paper of great width or transfer paper by great conveyance length is apt to take the heat of the fixing roller, whereby optimum conveyance may be effected in conformity with the characteristic of the fixing device and the size of the transfer paper.

<Sixth Embodiment>

In the fifth embodiment, the sheet supply delay time has been changed in conformity with the size of the transfer paper to thereby obtain the optimum throughput, while in a sixth embodiment, the sheet supply delay time is changed by the cassette sheet supply portion or the manual sheet supply portion. In this embodiment, as in the case of the third embodiment, there is the possibility of conveying thick paper, for example, in the manual sheet supply portion and in this case, heat is apt to be taken from the fixing roller. So, in the case of the manual sheet supply portion, the sheet supply delay time is made greater than usual. Therefore, as regards the control in the present embodiment, if at the step ST701 shown in FIG. 7, the sheet supply delay time and the delay time for each size of the transfer paper are set by the cassette sheet supply portion or the manual sheet supply portion, the detailed temperature control of the heater 1 and heater 2 will become possible.

<Seventh Embodiment>

In the fifth embodiment, the sheet supply delay time has been changed in conformity with the size of the transfer paper to thereby obtain the optimum throughput, while in a seventh embodiment, the sheet supply delay time is changed by the detected temperature at the start of the recording apparatus. In this embodiment, as in the case of the fourth embodiment, there is the possibility of conveying transfer paper of low temperature when for example, the environment is at a low temperature. In such case, heat is apt to be taken away from the fixing roller. So, when the environment is judged to be at a low temperature, the sheet supply delay time is made greater than usual. As regards the control in the present embodiment, if at a step ST701 shown in FIG. 7, the sheet supply delay time is set by the memorized temperature at the start, the detailed temperature control of the heater 1 and heater 2 will become possible.

<Eighth Embodiment>

Figure 8:
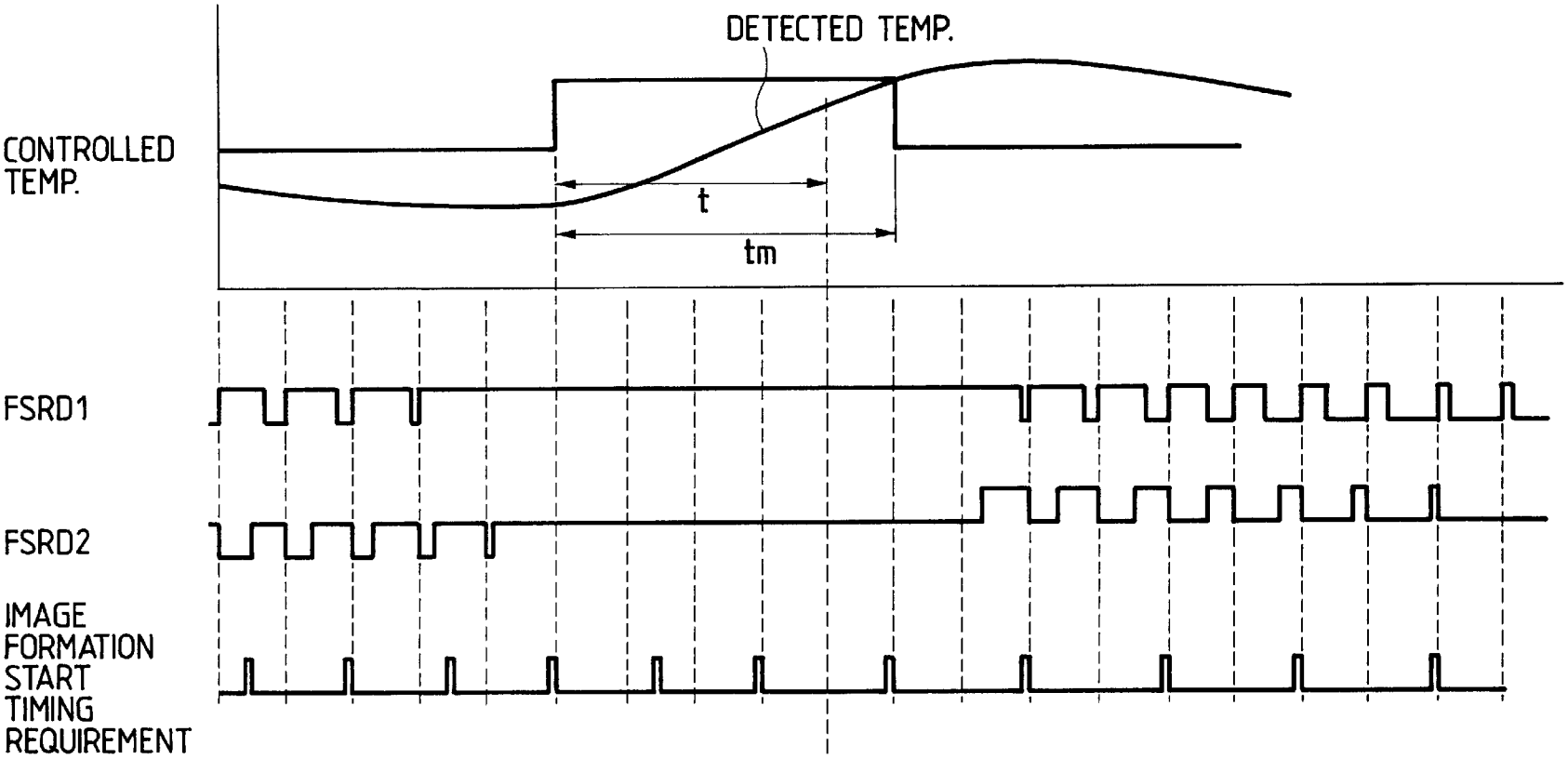
FIG. 8 is a time chart illustrating the control of a fixing device according to an eighth embodiment of the present invention.

FIG. 8 is a time chart illustrating an eighth embodiment. In the first embodiment, throughput down has been realized by delaying the sheet supply timing, while in the present embodiment, sheet supply is effected at ordinary timing, and by delaying the timing of image formation starting required of the image controller 202. Thus, it becomes possible to decrease the quantity of transfer paper passing the fixing roller per unit time, and the temperature of the fixing roller may be kept at the controlled temperature. That is, in the present embodiment, as in the first embodiment, the throughput down mode is entered at a point of time whereat reach time tm is larger than (>) set time t has been detected. The difference of the present embodiment from the first embodiment is that the requirement for the timing of image formation starting is delayed more than in the ordinary mode. The image controller 202 cannot send an image signal into the recording apparatus unless this requirement for the timing of image formation starting is inputted and transfer paper conveyance is stopped during that time, thus resulting in throughput down.

As described above, according to the present invention, the fixing member controls the electrical energization time of the heat generating member per unit time by control means, and when the electrical energization time has assumed a maximum electrical energization state. Thus, the environment is judged to be low temperature environment or low source voltage environment and the sheet supply interval is widened or the sheet supply speed is slowed down by passage amount decrease control means and therefore, any reduction in fixing performance can be prevented, and the fixing performance can be sufficiently secured even in a fixing device of low power consumption.

What is claimed is:

1. An image fixing apparatus, comprising:

a heating member for heating an unfixed image on a recording medium, wherein said heating member is maintained at a target temperature after electrical energization to said heating member is started;

electrical energization duty detecting means for detecting an electrical energization duty to said heating member; and judging means for judging whether a conveying amount of the recording medium should be changed when a detected duty reaches a predetermined value.

2. An image fixing apparatus according to claim 1, further comprising:

temperature rise ratio detecting means for detecting a temperature rise ratio of said heating member after the detected energization duty reaches a predetermined value, wherein said judging means controls the conveying amount of the recording medium in accordance with the temperature rise ratio.

3. An image fixing apparatus according to claim 2, wherein said judging means decreases the conveying amount of the recording medium during the temperature rise ratio a smaller amount than the predetermined temperature rise ratio.

4. An image fixing apparatus according to claim 1, wherein said electric energization duty detecting means measures electric energization time.

5. A temperature control method for controlling a temperature of an image heating member to be maintained at a target temperature, comprising the steps of:

gradually raising an electrical energization duty to said image heating member until the temperature of said image heating member reaches a first target temperature;

raising the target temperature to a second target temperature when the temperature of said image heating member is lower than the first target temperature despite the electrical energization duty having reached a predetermined value; and widening a conveying interval of recording materials when a temperature rise speed of said image heating member from the first target temperature up to the second target temperature is lower than a predetermined speed.

* * * * *

UNITED STATES PATENT AND TRADEMARK OFFICE

CERTIFICATE OF CORRECTION

PATENT NO. : 5,875,373

DATED : February 23, 1999

INVENTOR(S) : KAORU SATO, ET AL.

It is certified that error appears in the above-identified patent and that said Letters Patent is hereby corrected as shown below:

COVER PAGE [54] TITLE,
"CONVEYANCE" should read --CONVEYANCE OF--.

COVER PAGE [56] RC,
Insert, --5,196,885 3/1993 Takeuchi, et al.--, --5,303,015 4/1994 Sato--, --5,334,817 8/1994 Nakamori, et al.--, and --5,450,170 9/1995 Kimizuka, et al.--.

Figure 2:
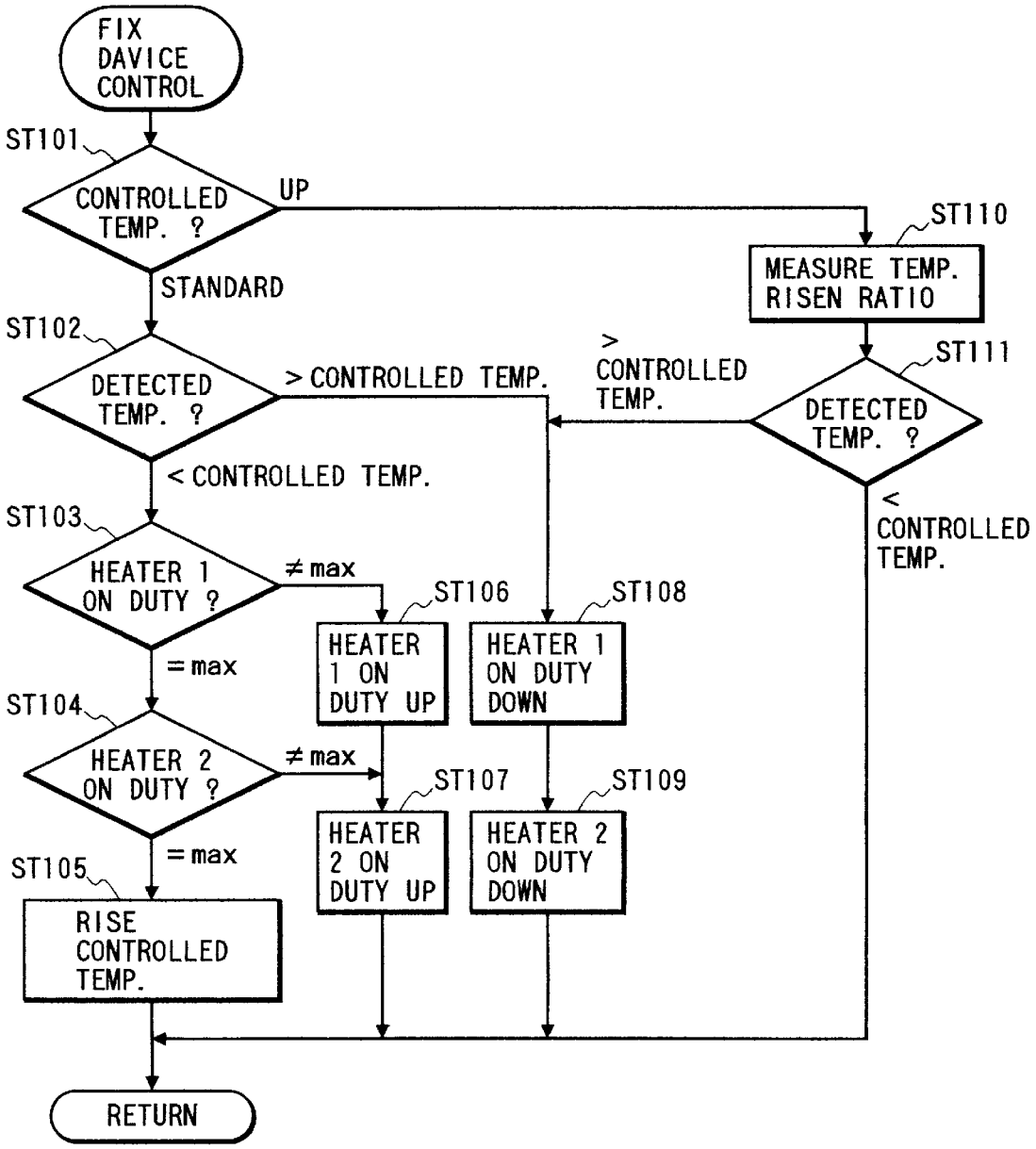
FIG. 2 is a flow chart illustrating the control of a fixing device according to a first embodiment of the present invention.

FIGURE 2,
"DAVICE" should read --DEVICE--.

COLUMN 1,
Line 1, "CONVEYANCE" should read --CONVEYANCE OF--;
Line 20, "it" should read --its--; and
Line 21, "till" should read --until--.

Signed and Sealed this

Fourteenth Day of September, 1999

*Attest:*

Q. TODD DICKINSON

*Attesting Officer*

*Acting Commissioner of Patents and Trademarks*

UNITED STATES PATENT AND TRADEMARK OFFICE

CERTIFICATE OF CORRECTION

PATENT NO. : 5,875,373
DATED : February 23, 1999
INVENTOR(S) : Kaoru Sato et al.

It is certified that error appears in the above-identified patent and that said Letters Patent is hereby corrected as shown below:

Title page, Item [54] and Column 1, line 1,
"CONVEYANCE A" should read -- CONVEYANCE OF A --.
Item [56], References Cited, U.S. PATENT DOCUMENTS, insert
-- 5,196,885 3/1993 Takeuchi, et al. --,
-- 5,303,015 4/1994 Sato --,
-- 5,334,817 8/1994 Nakamori, et al. --, and
-- 5,450,170 9/1995 Kimizuka, et al. --.

Drawings,
Figure 2, "DAVICE" should read -- DEVICE --.

Column 1,
Line 20, "it" should read -- its --; and
Line 21, "till" should read -- until --.

Signed and Sealed this

Twenty-sixth Day of November, 2002

*Attest:*

*Attesting Officer*

JAMES E. ROGAN
*Director of the United States Patent and Trademark Office*